United States Patent [19]

Metro et al.

[11] Patent Number: 4,655,946

[45] Date of Patent: Apr. 7, 1987

[54] SEA WATER RESISTANT TURBO OIL

[75] Inventors: Stephen J. Metro, Middletown; Dale D. Carr, Morristown, both of N.J.

[73] Assignee: Exxon Research and Engineering Company, Florham Park, N.J.

[21] Appl. No.: 795,825

[22] Filed: Nov. 7, 1985

[51] Int. Cl.[4] ..... C10M 137/08

[52] U.S. Cl. ..... 252/32.5; 252/35; 252/38; 252/51.5 A; 252/52 R; 252/56 S

[58] Field of Search ..... 252/32.5, 51.5 A, 52 R, 252/56 S, 35, 38

[56] References Cited

U.S. PATENT DOCUMENTS 2,786,028 3/1957 Gottshall et al. ..... 252/32.5
3,684,726 8/1972 Haak et al. ..... 252/33.2
3,785,975 1/1974 Humphrey et al. ..... 252/32.5
4,156,655 5/1979 Clarke et al. ..... 252/18

*Primary Examiner*—Jacqueline V. Howard
*Attorney, Agent, or Firm*—Edward H. Mazer; Joseph J. Dvorak

[57] ABSTRACT

A turbo lube oil resistant to sea water corrosion is disclosed. The turbo lube oil comprises:

A. a basestock;
B. an alkylphenol;
C. a salicylate;
D. polyisobutylene-succinic acid/amine reaction product;
E. a phosphate salt; and
F. a naphthenate.

19 Claims, No Drawings

SEA WATER RESISTANT TURBO OIL

BACKGROUND OF THE INVENTION

This invention is related to an improved lube oil. More specifically, the present invention is directed to a turbo oil having improved resistance to sea water corrosion.

In the past the corrosion resistant turbo oils which were used for jet engines in storage were not suitable for flying service because of excessive deposit formation. Because of this, the oil used during storage and transit had to be drained and replaced by a flying service type turbo oil before flight. This results in additional servicing of aircraft prior to initial flight, thereby increasing the cost and time to prepare the aircraft. In addition, stocks of both corrosion resistant storage/-transit oil and turbo oil suitable for flying service have had to be maintained.

Work previously has been done to provide hydraulic and lubricating oil compositions which prevent corrosion of metal surfaces exposed to sea water. U.S. Pat. No. 3,872,048 discloses the use of the reaction product of an alkylated succinic anhydride, a polyethylene amine and a polyhydric alcohol. However, this composition would not be suitable for storage and operational use in turbine engines, since the composition tends to form deposits and is poor in oxidation stability.

U.S. Pat. No. 4,156,655 discloses a grease having improved resistance to salt water corrosion which has a metal naphthenate, preferably a zinc naphthenate, present. While this grease may be resistant to salt water corrosion, the corresponding lube oil with the disclosed additives would not be satisfactory as a turbo lube oil because a turbo lube oil having only zinc naphthenate present would not pass the standard salt water corrosion test, ASTM test D-665.

U.S. Pat. No. 3,684,726 also discloses the use of naphthenates of lead, zinc and lithium in greases for improved salt water corrosion resistance. While this patent discloses the use of metal naphthenates, there is no disclosure or suggestion of using the presently claimed combination of additives in a lube oil basestock to provide an improved turbo lube oil.

U.K. Pat. No. 1,117,349 discloses a gasoline additive useful in preventing carburetor icing and rusting comprising, in part, the reaction product of polyisobutylene succinic anhydride, tetraethylene pentamine and the ammonium salt of a phosphate ester. This patent also does not suggest or disclose the use of all of the presently claimed components in a turbo lube oil suitable for storage and also for operational use.

Accordingly, it would be desirable to provide a sea water resistant turbo oil which also is suitable for fly-away service.

It also would be desirable to provide a turbo oil for jet engines which does not require drainage and replacement prior to initial use of the engine.

The present invention is directed at a turbo oil comprising:

an ethoxylated alkylphenol;
a zinc salicylate;
a polyisobutylene-succinic acid/amine reaction product;
mono- and dihexyl phosphate salts of $C_{11}$–$C_{14}$ monoamines;
zinc naphthenate; and
basestock.

SUMMARY OF THE INVENTION

A turbo lube oil comprising:

A. a basestock;
B. an alkylphenol;
C. a salicylate salt;
D. a polyisobutylene-succinic acid/amine reaction product;
E. a phosphate salt; and
F. a naphthenate.

The total concentration of the alkylphenol, salicylate salt and polyisobutylene-succinic acid/amine reaction product ranges between about 0.005 and about 1.5 weight percent, preferably between about 0.05 and about 0.15 weight percent of the basestock. The phosphate salt concentration ranges between about 0.01 and about 2 weight percent, preferably between about 0.05 and about 0.2 weight percent of the basestock. The naphthenate concentration ranges between about 0.006 and about 0.6 weight percent, preferably between about 0.01 and about 0.2 weight percent based upon the basestock.

The preferred composition preferably further comprises:

A. tricresylphosphate;
B. dioctyldiphenylamine;
C. octylphenyl α-naphthylamine;
D. n-octylphenothiazine; and
E. 1,4-dihydroxyanthraquinone.

The concentration of the tricresylphosphate may range between about 0.5 and about 5.0 weight percent, preferably between about 1.0 and about 3.5 weight percent of the basestock. The dioctyldiphenylamine concentration ranges between about 0.5 and about 4.0 weight percent, preferably between about 1.0 and about 2.5 weight percent of the basestock. The octylphenyl α-naphthylamine concentration ranges between about 0.5 and about 5.0 weight percent, preferably between about 0.5 and about 2.5 weight percent of the basestock. The concentration of the n-octylphenothiazine ranges between about 0.005 and about 1.0 weight percent, preferably between about 0.01 and about 0.05 weight percent of the basestock. The 1,4-dihydroxyanthraquinone concentration ranges between about 0.01 and about 1.0 weight percent, preferably between about 0.05 and about 0.30 weight percent of the basestock.

The subject invention provides a turbo lube oil suitable for flying service which has improved corrosion resistance to sea water.

DETAILED DESCRIPTION OF THE INVENTION

The present invention is directed at a turbo lube oil having improved resistance to sea water corrosion comprising a basestock, an alkyl-phenyl, a salicylate, a polyisobutylene-succinic acid/amine reaction product, a phosphate salt and a naphthenate.

The base oil preferably comprises the ester reaction product of acids and alcohols. The alcohols preferably comprise 60 mole percent pentaerythritol and 40 mole percent trimethylolpropane. The acids preferably comprise $C_6$+ acids. A preferred acid composition comprises:

| Acid | Mole Percent |
|---|---|
| $C_7$ | 45–55 |

-continued

| Acid | Mole Percent |
|---|---|
| $C_8$ | 26–36 |
| $C_{10}$ | 13–23 |

The alkylphenol utilized preferably comprises an ethoxylated alkylphenol.

The salicylate preferably may comprise a variety of metallic salts of salicylic acid. The salicylate may be a salt formed from metals of Group I to Group IV of the Mendeleev periodic table with the alkali and alkaline earth metal salts and the heavy metal salts being most effective. The more preferred are zinc, lead and lithium salicylates, with zinc salicylate being particularly preferred.

The polyisobutylene-succinic acid/amine (PIBSA) reaction product preferably comprises the reaction product of polyisobutylene-succinic acid/amine.

The phosphate salt may be a mixture of mono- and dihexyl phosphate salted with an amine, preferably a $C_{11}$–$C_{14}$ amine. Particularly preferred phosphate salts are mono- and dihexyl phosphate salts of $C_{11}$–$C_{14}$ mono-amines.

The naphthenate utilized in the present invention preferably comprises a metal naphthenate. In general, a variety of metallic salts of naphthenic acid can be used in the rust inhibitor of the present invention. As is well known, the term "naphthenic" acids is applied to mixtures of carboxylic acids generally obtained from the alkali washes of petroleum fractions. Generally, the naphthenic acids are complex mixtures of normal and branched aliphatic acids, alkyl derivatives of cyclopentane and cyclohexane carboxylic acids and cyclopentyl and cyclohexyl derivatives of aliphatic acids. The naphthenate may be a salt formed from metals of Group I to IV of the Mendeleev periodic table with the alkali and alkaline earth metal salts and the heavy metal salts being most effective and are, therefore, particularly useful. Zinc, lead, lithium and magnesium are the preferred metal naphthenates used in this invention, with zinc naphthenate being particularly preferred.

A summary of the composition of the present invention and concentration ranges of the compounds relative to the basestock is set forth in Table I below.

TABLE I

| Compound | Concentration Range (Wt. % Relative to Basestock) | Preferred Concentration Range (Wt. % Relative to Basestock) |
|---|---|---|
| A. Ethoxylated Alkyl Phenol<br>B. Salicylate Salt<br>C. Polyisobutylene-Succinic Acid Amine Reaction Product | 0.005–1.5 | 0.05–0.15 |
| D. Mono- and Dihexyl Phosphate Salts of $C_{11}$–$C_{14}$ Mono-Amines | 0.01–2.0 | 0.05–0.2 |
| E. Naphthenate | 0.006–0.6 | 0.01–0.20 |

In addition to the compounds set forth in Table I, the turbo lube oil preferably comprises several additional compounds. Tricresylphosphate may be added as a metal passivator, while 1,4-dihydroxyanthraquinone may be added as a corrosion inhibitor. Dioctyldiphenylamine, octylphenyl-α-naphthylamine, and n-octylphenothiazine may be added as antioxidants. A summary of the concentration ranges for these compounds is set forth in Table II below.

TABLE II

| Compound | Concentration Range (Wt. % Relative to Basestock) | Preferred Concentration Range (Wt. % Relative to Basestock) |
|---|---|---|
| Tricresylphosphate | 0.05–5.0 | 1.0–3.5 |
| 1,4-Dihydroxyanthraquinone | 0.01–1.0 | 0.05–0.30 |
| Dioctyldiphenylamine | 0.05–4.0 | 1.0–2.5 |
| Octylphenyl-α-Naphthylamine | 0.05–5.0 | 0.5–2.5 |
| n-Octylphenothiazine | 0.005–1.0 | 0.01–0.05 |

A preferred turbo lube oil has the composition set forth in Table III below:

TABLE III

LUBRICATING OIL COMPOSITION

| Compound | Concentration Relative to Basestock (Wt. %) |
|---|---|
| Basestock | 100 |
| Ethoxylated Alkyl Phenol | 0.08 |
| Salicylate Salt | 0.015 |
| Polyisobutylene-Succinic Acid/ Amine Reaction Product | 0.015 |
| Phosphate Salt | 0.1 |
| Naphthenate | 0.06 |
| Tricresylphosphate | 3.0 |
| 1,4-Dihydroxyanthraquinone | 0.1 |
| Dioctyldiphenylamine | 1.5 |
| Octylphenyl-α-Naphthylamine | 1.5 |
| n-Octylphenothiazine | 0.02 |

The utility of the present invention may be seen from the following comparative examples and examples in which lube base oils were evaluated and in which various concentrations of the previously noted compounds were added to the preferred lube oil base oil. The following tests were run on the samples.

A. D-665 Sea Water Rust Test;

B. Oxidation and Corrosion Stability Study (OCS);

C. Pressure Cylinder Corrosion Test (PCT); and

D. Inclined Panel Deposit Test (IPDT).

The details of the tests are set forth below:

ANSI/ASTM standard D665, the disclosure of which is incorporated herein by reference, is directed at a test for determining the ability of oil to aid in preventing the rusting of ferrous parts should water become mixed with the oil. In this test a mixture of 300 ml. of the test oil is stirred with 30 ml. of distilled or synthetic sea water at a temperature of 60° C. with a cylindrical steel specimen completely immersed therein for an extended period of time, such as 24 hours, although longer and shorter periods of time also may be utilized.

The Oxidation Stability and Corrosiveness Study (OCS) is used to determine the ability of oils to resist oxidation and the tendency of the oil to corrode various metals. Samples of various metals, such as silver, aluminum, copper, magnesium and steel, are weighed prior to being inserted into a sample of the test oil. Five liters/hr. of air is passed though the sample maintained at 400° F. for an extended period of time, e.g., 72 hours, after which the weight loss and of the metal samples is measured and their condition examined for pitting and etching. The oil sample is examined for evidence of insoluble or gummy material. The viscosity and the neutralization number of the sample is also calculated. This procedure is described in more detail in Federal Test Method Standard No. 791B, the disclosure of which is incorporated herein by reference.

The Pressure Cylinder Corrosion Test (PCT) is designed to measure the extent to which the oil being tested corrodes metal surfaces. Pre-weighed AMS 5504 stainless steel panels are immersed in nickel bombs containing the oil being tested for 144 hours at 525° F. without aeration to simulate high temperature stagnation. Deposits on the panels are removed and the panels re-weighed. The extent of corrosion due to contact with the oil is determined by calculating the weight loss of the panels from contact with the oil.

The Inclined Panel Deposit Test (IPDT) is directed at determining the deposit forming tendency of a lube oil in the oil washed areas of a turbine engine. A sample of the test oil is recirculated at 540° F. across a panel for 24 hours. Visual examinations are made of the panel before and after the test. At the end of the test, samples of the oil are examined for both physical and chemical changes. This test is used to predict deposit formation in the more extensive bearing rig tests.

The basestock utilized in the following tests comprised a combination of trimethylolpropane and pentaerythritol esters. This combination exhibited the following qualities: good availability; relatively low volatility; low acidity; low copper corrosion; low deposit formation; and good oxidation stability with an advanced additive package.

COMPARATIVE EXAMPLE 1

A base oil was formulated for the following tests comprising the basestock described above and the additives of Table II at the preferred concentration levels. In this test no further additives were added to the base oil. As shown in Table IV, for Run No. 1, the base oil without any additional additives exhibited a very high rate of pitting and a very high rate of rust formation.

COMPARATIVE EXAMPLES 2–7

In these comparative examples, shown as Run Nos. 2–7, also presented in Table IV, it has been shown that addition of some, but not all, of the additives decreased the rate of pitting and the rate of rust formation, as compared to the base oil without any additive. However, the rate of pitting and rust formation still was undesirably high.

COMPARATIVE EXAMPLE 8

In this comparative example, shown as Run No. 8 in Table IV, the ethoxylated alkylphenol, zinc salicylate and PIBSA concentration in the base oil were the same as in Run Nos. 2, 5 and 6 of Table IV. The zinc naphthenate concentration was double that used in Run Nos. 4, 6 and 7 of Table IV. It may be seen that the rate of pitting and the rate of rust formation improved significantly. However, the Oxidation Stability and Corrosion Study and the Inclined Panel Deposit Test gave relatively poor results.

EXAMPLE 1

In this Example the ethoxylated alkylphenol, zinc salicylate, PIBSA and zinc naphthenate were present in a total concentration of about 0.115 weight percent. In addition, 0.05 weight percent of a mixture of mono- and dihexyl phosphate salts of $C_{11}$–$C_{14}$ mono-amines was added to the base oil. As shown in Run No. 9 of Table IV, this produced an oil having acceptable pitting and rust inhibiting characteristics. However, the Oxidation Stability and Corrosion Study test result on the rate of copper corrosion was unacceptably high.

EXAMPLE 2

In this Example, shown as Run No. 10 in Table IV, the same concentration of additives used in Example 1 (Run No. 9) were utilized, with the exception being that the concentration of the mixture of mono-and dihexylphosphate salts of $C_{11}$–$C_{14}$ mono-amines utilized was doubled from 0.05 weight percent to 0.10 weight percent and the total concentration of ethoxylated alkylphenol, zinc salicylate and PIBSA was doubled from 0.055 weight percent to about 0.11 weight percent. Table IV clearly shows that by these increases, it was possible to reduce the copper corrosion rate substantially, while not adversely affecting the overall performance of the lube oil.

TABLE IV

COMPOSITION* AND PERFORMANCE CHARACTERISTICS OF BASE OIL WITH INDICATED ADDITIVES

| | Test No. | | | | | | | | | |
|---|---|---|---|---|---|---|---|---|---|---|
| Additive | 1 | 2 | 3 | 4 | 5 | 6 | 7 | 8 | 9 | 10 |
| Alkylphenol | — | 0.08 | — | — | 0.08 | 0.08 | — | 0.08 | 0.04 | 0.08 |
| Salicylate | — | 0.015 | — | — | 0.015 | 0.015 | — | 0.015 | 0.0075 | 0.015 |
| PIBSA | — | 0.015 | — | — | 0.015 | 0.015 | — | 0.015 | 0.0075 | 0.015 |
| Phosphate Salt | — | — | 0.1 | — | 0.1 | — | 0.1 | — | 0.05 | 0.1 |
| Naphthenate | — | — | — | 0.06 | — | 0.06 | 0.06 | 0.12 | 0.06 | 0.06 |
| Performance | | | | | | | | | | |
| D-665 Test | 7/100 | 4.1/10 | 6/100 | 4.3/20 | 4.3/20 | 3.1/1 | 6/100 | 1/0 | 1/0 | 1/0 |
| (rating/% rust) | 7/100 | 4.1/10 | 6/100 | 4.3/20 | 4.7/40 | 3.1/1 | 6.5/100 | 1/0 | 1/0 | 1/0 |
| IPDT | | | | | | | | 3.23 | 2.14 | 2.65 |
| PCT | | | | | | | | — | 19 | 15–30 |
| OCS, Cu | | | | | | | | −0.35 | −0.38 | −0.2 |

TABLE IV-continued

| COMPOSITION* AND PERFORMANCE CHARACTERISTICS OF BASE OIL WITH INDICATED ADDITIVES | | | | | | | | | | |
|---|---|---|---|---|---|---|---|---|---|---|
| | Test No. | | | | | | | | | |
| Additive | 1 | 2 | 3 | 4 | 5 | 6 | 7 | 8 | 9 | 10 |
| (mg/cm$^2$) | | | | | | | | | | |

*Expressed as weight percent of basestock.

What is claimed is:

1. A lubricating oil composition comprising:

A. a base oil;

B. an alkylphenol;

C. a salicylate salt;

D. polyisobutylene succinic acid/amine reaction product;

E. phosphate salt of an amine; and,

F. a naphthenate;

the total concentration of the alkylphenol, salicylate salt and polyisobutylene succinic acid/amine reaction product being in the range of between about 0.005 and about 1.5 wt %, the phosphate salt of an amine being present in an amount ranging between about 0.01 and about 2 wt %, and the naphthenate concentration ranging between about 0.006 and about 0.6 wt %.

2. The composition of claim 1 wherein the naphthenate comprises a metal naphthenate.

3. The composition of claim 2 wherein the metal naphthenate is selected from metals of Group I to Group IV of the Periodic Table.

4. The composition of claim 3 wherein the metal naphthenate is selected from the group consisting of alkali metal salts, alkaline earth metal salts and heavy metal salts.

5. The composition of claim 4 wherein the metal naphthenate is selected from the group consisting of zinc, lead, lithium and magnesium naphthenates and mixtures thereof.

6. The composition of claim 5 wherein the naphthenate comprises zinc naphthenate.

7. The composition of claim 1 wherein the alkylphenol comprises an ethoxylated alkylphenol.

8. The composition of claim 1 wherein the salicylate comprises a metal salicylate.

9. The composition of claim 8 wherein the salicylate salt is a Group IIB salt.

10. The composition of claim 9 wherein the salicylate salt comprises zinc salicylate.

11. The composition of claim 1 wherein the amine of said phosphate salt comprises $C_{11}$–$C_{14}$ mono-amines.

12. The compositions of claim 11 wherein the phosphate salt of $C_{11}$–$C_{14}$ amines comprises mono- and dihexyl phosphate salts of $C_{11}$–$C_{14}$ mono-amines.

13. The composition of claim 1 wherein the basestock comprises pentaerythritol and trimethylolpropane esters.

14. The composition of claim 1 wherein the total concentration of the alkylphenol, salicylate salt and polyisobutylene-succinic acid/amine reaction product ranges between about 0.05 and about 0.15 weight percent of the basestock.

15. The composition of claim 14 wherein the phosphate salt concentration ranges between about 0.05 and about 0.2 weight percent of the basestock.

16. The composition of claim 15 wherein the naphthenate concentration ranges between about 0.01 and about 0.20 weight percent of the basestock.

17. The composition of claim 15 further comprising the addition of one or more compounds selected from the group consisting of tricresylphosphate, dioctyldiphenylamine, octylphenyl-α-naphthylamine, n-octylphenothiazine, and 1,4 dihydroxyanthraquinone.

18. A turbo lubricating oil comprising an ester basestock and the following additives at the indicated concentrations relative to the basestock:

A. about 0.005 to about 1.5 wt.% total of ethoxylated alkylphenol, salicylate salt and polyisobutylene succinic acid/amine reaction product;

B. about 0.01 to about 2.0 wt.% phosphate salt of an amine; and,

C. about 0.006 to about 0.6 wt.% naphthenate.

19. The turbo lubricating oil of claim 18 comprising the following additives at the indicated concentrations relative to the ester basestock:

A. about 0.05 to about 0.15 total wt.% total of ethoxylated alkylphenol, salicylate salt and polyisobutylene succinic acid/amine reaction product;

B. about 0.05 to about 0.2 wt.% phosphate salt of an amine; and,

C. about 0.01 to about 0.20 wt.% naphthenate.

* * * * *